United States Patent [19]

Altus

[11] Patent Number: 4,579,278

[45] Date of Patent: Apr. 1, 1986

[54] SEE-THRU METALLIC FOOD WRAPPER

[75] Inventor: Mark Altus, Huntington Woods, Mich.

[73] Assignee: The 2500 Corporation, Birmingham, Mich.

[21] Appl. No.: 234,843

[22] Filed: Feb. 17, 1981

Related U.S. Application Data

[63] Continuation-in-part of Ser. No. 43,347, May 29, 1979.

[51] Int. Cl.[4] ..... B65D 65/00; B65D 75/00

[52] U.S. Cl. ..... 229/87 F; 206/45.31

[58] Field of Search ..... 229/87 F, 87 B; 206/45.31

[56] References Cited

U.S. PATENT DOCUMENTS

| | | | |
|---|---|---|---|
| 1,949,161 | 2/1934 | Haug | 206/46 |
| 2,047,980 | 7/1936 | Olm | 206/44 |
| 2,240,072 | 4/1941 | Hodgdon | 154/50 |
| 2,333,943 | 11/1943 | Levkoff | 229/14 |
| 2,465,841 | 3/1949 | Bonini | 229/87 |
| 2,475,052 | 7/1949 | Rosen | 229/DIG. 3 |
| 3,276,671 | 10/1966 | Fleitman | 229/87 B |
| 3,402,052 | 9/1968 | Walker | 99/172 |

FOREIGN PATENT DOCUMENTS

| | | | |
|---|---|---|---|
| 660809 | 4/1963 | Canada | 229/87 B |

*Primary Examiner*—Joseph Man-Fu Moy

*Attorney, Agent, or Firm*—Dolgorukov & Dolgorukov

[57] ABSTRACT

The specification discloses a see-thru metallic food wrapper which has a specially adapted transparent viewing strip provided in the normally solid wrapper material, both of which have physical properties which allow their use at both high and low temperatures. The transparent strip preferably extends in a longitudinal direction in the middle of the food wrapper.

7 Claims, 3 Drawing Figures

Fig-1
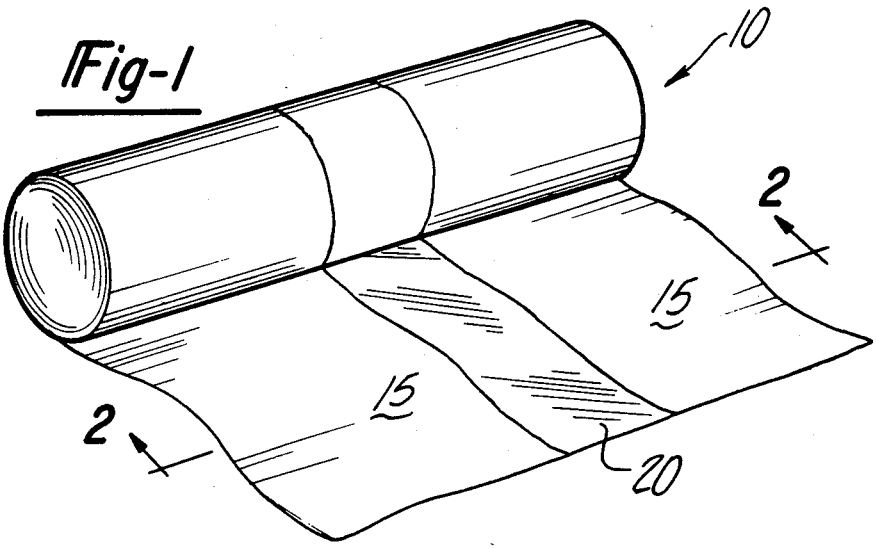
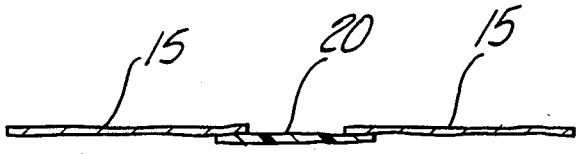
Fig-2
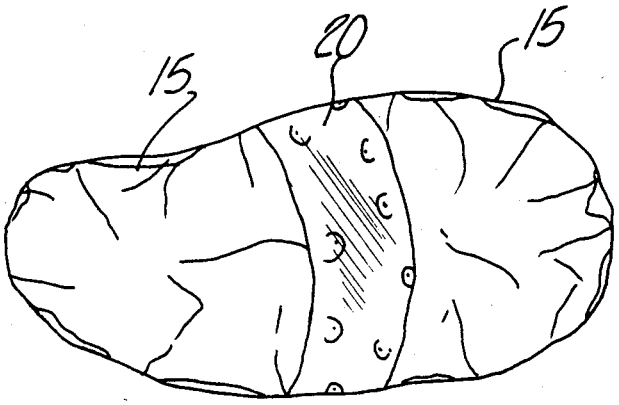
Fig-3

SEE-THRU METALLIC FOOD WRAPPER

This application is a continuation-in-part of my earlier co-pending application, Ser. No. 043,347, filed on May 29, 1979, for See-Thru Metallic Food Wrapper, the specification of which is specificially incorporated herein by reference.

The present invention relates to food wraps, and more particularly to an improved see-thru metallic food wrapper which answers a long term need for an economical food wrapper which can be used at both high and low temperatures, and allow a view of the contents of the wrapper at all times.

A review of the prior art discloses that as of this date there exists no economical food wrapper which can be used both at high baking tempertures, and low freezing temperatures, and allow a view of the contents thereof. Further, the state of the art in the packaging industry does not teach the use of combining aluminum foil with a transparent nylon film joined together with a heat sealing process.

Applicant, in an effort to answer this long-term need has invented a novel see-thru metallic food wrapper which allows the immediate visual identification of the food contents therein, and the immediate placement of the enclosed food in either a low or high temperature environment without the necessity of unwrapping the food.

The advantage of this new and unique food wrapper are obvious from both economic and utilitarian viewpoints. The combination of aluminum foil with a transparent nylon film joined together with a heat sealing process results in the following benefits: (1) it is nontoxic at any temperature from approximately −20° F. to 400° F.; (2) it has a transparency feature which allows the wrap to remain intact while permitting the observer to identify the contents; (3) it is useable at extreme temperature ranges from approximately −20° F. to 400° F. and does not breakdown in this temperature range; (4) it imparts no taste, aroma, or other sensory attributes to the food which is wrapped within it; (5) it does not absorb moisture from the contents, nor permits food to dry out; (6) the aluminum and nylon is bonded in such a fashion as to withstand the temperature extremes noted above and remain intact; and (7) the material can be made to conform to the shape of foods or containers without other fastening devices.

I have been able to take advantage of the current state of technological scientific advancements relating to the new kinds of materials now in production and the new methods used to sealingly join these materials together.

Thus, one of the objects of the present invention is to provide a see-thru metallic food wrapper which is economical.

A further object of the present invention is to provide a food wrapper which can be placed around various shaped foods without the necessity of using any other fastening or sealing device.

A further object of the present invention is to provide a food wrapper which can be used at extreme cold or hot temperatures.

A still further object of the present invention is to provide a food wrapper which is partially transparent so that the type of food in the wrapper is clearly visible.

A still further object of the present invention is to provide an improved food wrapper by the heat sealing of aluminum and nylon together.

A still further object of the present invention is to provide a food wrapper which is nontoxic between a temperature range of −20° F. to 400° F.

A still further object of the present invention is to provide a food wrapper which remains intact and does not breakdown within the −20° F. to 400° F. temperature range.

Further objects and advantages of this invention will be apparent from the following description and appended claims, reference being had to the accompanying drawings forming a part of this specification, wherein like reference characters designate corresponding parts in the several views.

STATEMENT OF PATENTABILITY

As part of the disclosure of the present invention, I wish to make the following "Statement of Patentability":

I did, prior to the preparation of this application, cause a search to be made through the records of the U.S. Patent Office on my see-thru metallic food wrapper within Class 229, subclasses 87 B, 87 F and 87 R, and I discovered the following patents:

| | | |
|---|---|---|
| C. F. Haug | (1934) | 1,949,161 |
| O. J. Olm et al. | (1936) | 2,047,980 |
| P. E. Hodgdon et al. | (1941) | 2,240,072 |
| D. Levkoff | (1943) | 2,333,943 |
| J. H. Bonini | (1949) | 2,465,841 |
| R. J. Walker | (1968) | 3,402,052 |

After a careful review of each of the above patent references, which was disclosed by my search of the Patent Office records, it is my opinion that the only patent reference which is material to the examination of the present invention would be the "O. J. Olm et al." patent, entitled "WRAPPED PACKAGE".

It is further my opinion that although the "Olm" patent is material to the examination, it does not anticipate my invention, and can be easily distinguished on several grounds. First, a review of the "Olm" patent discloses an invention entitled a "Wrapped Package" which comprises a package consisting of a commodity and a wrapper or enclosure therefor. One specific embodiment discloses a composite wrapper made in three sections in which the outer marginal sections are of relatively opaque material and the central section is of a highly transparent material which may be "cellophane" or other thin transparent material. The opaque and transparent materials are secured, edge to edge, in an overlapping relation by a suitable adhesive. The specification further discloses that the opaque and transparent materials can be combined either in pairs or in large numbers, thus, resulting in more than one transparent strip.

Although at first glance the "Olm" patent may seem to be somewhat similar to my invention, upon a reading of the specification below, it will be seen that my invention is clearly patentable thereover.

First, until the present invention, the combination of a metallic and transparent material in a food wrap which could withstand both extreme high and low temperatures was unheard of, and only new technological advancements relating to new kinds of materials and the methods of sealing them together, to be discussed below, made the present invention possible. It is this novel combination of materials and the method of joining them together which make my invention both an improvement over the prior art and nonobvious.

Also, "Olm" does not claim to disclose the use of the combination of the below-disclosed materials which have the physical characteristic of being able to function as a food wrapper at the extreme temperatures necessary during baking and freezing cycles. Further "Olm" does not disclose an adhesive which is operable over the temperature range of the present invention. In addition, "Olm" does not disclose that his adhesive is nontoxic throughout said range.

The "Olm" patent relies on the use of a wrapper comprising a composite sheet structure formed of portions or sections of cellulosic material which are held together by a suitable adhesive. Neither the use of cellulosic material or a suitable adhesive could function and effectively perform as a see-thru metallic food wrapper, as disclosed by my invention.

FIG. 1 is a perspective view of a see-thru metallic food wrapper embodying the construction of my invention.

FIG. 2 is a sectional view of the see-thru metallic food wrapper taken in the direction of the arrows along the section line 2—2 of FIG. 1.

FIG. 3 illustrates one use of a see-thru metallic food wrapper embodying my invention.

It is to be understood that the present invention is not limited in its application to the details of constructions and arrangement of parts illustrated in the accompanying drawings, since the invention is capable of other embodiments and of being practiced or carried out in various ways within the scope of the claims.

Also, it is to be understood that the phraseology and terminology employed herein is for purpose of description and not of limitation.

Referring specifically to FIGS. 1 and 2, there is shown a roll of my improved food wrapping material generally designated by the numeral 10 and having a transparent portion 20 in the middle thereof, with two opaque sections 15 on either side. The opaque portions can be of any material which is thin, light flexible, and nontoxic and can withstand a range of temperatures which would be encountered in going from a freezing situation to a baking situation rapidly. A preferred temperature range would be from −20° F. to 400° F. One material which is commonly used is aluminum foil and this is the peferred material, although any metallic or other type material which meets the conditions specified above is well within the scope of the present invention.

Bonded to the metallic material 15 by a heat sealing process is a strip of transparent material designated by the numeral 20. As before, any transparent material which can go from a freezing temperature to a baking temperature in a relatively short period of time is suitable, and the preferred embodiment for the foil is a high heat resistant nylon film, but any material which can withstand a temperature range of approximately −20° F. to 400° F. is suitable.

As is well known in the art, a transparent material which has a satisfactory working range of approximately −20° F. to 400° F. will be one wherein such transparent mterial will maintain its nontoxic properties throughout the entire range.

As shown in FIG. 2, the transparent strip 2 is heat sealed to the opaque strip 15 in the preferred embodiment, but this seal, although not shown, can also be achieved by using some of the newer adhesives, such as epoxies, hot melt glue and some of the new cyanoacrylate instant glues, as long as when the bond is completed the adhesive assumes a nontoxic condition over the temperature range mentioned above. It should be understood that however the joint is accomplished, it must have nontoxic properties througout the −20° F. to 400° F. temperature range.

While as mentioned above the transparent strips can be sealed to the opaque strips either by a chemical adhesive or heat sealing, heat sealing is preferred because it lends itself to a faster manufacturing process, thus simplifying the same and making my novel metallic food wrapper more inexpensive in its manufacture. Also, the use of the heat sealing process allows for more flexibility in the design of the food wrapper because if various shapes and sizes of strips are used, relatively simple heat sealing dies can be used, instead of the more complicated adhesive applying and curing processes.

Thus, the combination of aluminum and nylon by a heat sealing process provides a unique, improved and novel food wrapper material which is both nontoxic and highly durable within a large temperature range, and is not anticipated by any other food wrapping materials found in the market place.

Referring now to FIG. 3, one use of my wrapping material is shown in that a ham is wrapped in the material with the transparent strip going completely around the ham so one may view it either when the ham is frozen, or when it is being cooked.

Although not shown, it is contemplated that the transparent strip 20 could be the entire width of the sheet 10 and be bonded only at the junction of the transparent strip 20 and the foil 15, or the transparent strip 20 could be intermediate two strips of opaque material on each side thereof for extra strength. All of these alternatives are well within the scope of the claims of the present invention. It is also contemplated that the transparent strip could either be provided longitudinally or transversely, and be well within the scope of the invention.

Referring again to FIG. 3, which illustrates one use of my see-thru metallic food wrapper, it can be readily seen that my invention can be easily used on any configuration or shape, since the wrapper may be cut of at any desired length.

While I have disclosed in this application a preferred embodiment of my invention, it is to be understood that my invention could consist of metallic and transparent strips combined in other sequences in either pairs or larger numbers, with various thicknesses and widths of the material used. Also, my metallic food wrapper could be manufactured in another form, instead of a rolled sheet construction as disclosed in the drawings.

For example, it would be easy to have my invention manufactured in sheets of predetermined lengths or formed into any other desired shapes or even made into bags. Thus, by using modern technology to provide a novel combination of materials by the heat sealing of aluminum to nylon which produces a higher durable and nontoxic improved food wrapper, a long standing problem in the art has been solved.

I claim:

1. A wrapping material including a plurality of alternating strips of transparent and metallic materials, said materials having a working temperature range of from at least −20° F. to 400° F., wherein said alternating strips are bonded together in an overlapping relationship about their common edge regions by a heat sealing process, said heat sealing process producing a joint having nontoxic properties throughout said temperature range.

2. A wrapper as defined in claim 1, wherein said transparent strip material is an intermediate relationship with said metallic strip material.

3. A wrapper as defined in claim 2, wherein said transparent and said metallic strips are of equal width.

4. The wrapper as defined in claim 3, wherein said metallic material is aluminum and said transparent material is a nylon film.

5. The wrapper as defined in claim 4, wherein said wrapper is formed into a continuous roll of a predetermined length.

6. The wrapper as defined in claim 4, wherein said wrapper consists of sheets of a predetermined size.

7. The wrapper as defined in claim 4, wherein said wrapper is formed into a bag.

* * * * *